US006732808B1

(12) United States Patent
Sprakel

(10) Patent No.: US 6,732,808 B1
(45) Date of Patent: May 11, 2004

(54) FIRE-EXTINGUISHING DEVICE

(75) Inventor: Dirk K. Sprakel, Cologne (DE)

(73) Assignee: Fogtec Brandschutz GmbH & Co. KG, Koln (DE)

( * ) Notice: Subject to any disclaimer, the term of this patent is extended or adjusted under 35 U.S.C. 154(b) by 214 days.

(21) Appl. No.: 10/110,597

(22) PCT Filed: Aug. 31, 2000

(86) PCT No.: PCT/EP00/08474

§ 371 (c)(1),
(2), (4) Date: Apr. 12, 2002

(87) PCT Pub. No.: WO01/26740

PCT Pub. Date: Apr. 19, 2001

(30) Foreign Application Priority Data

Oct. 13, 1999 (DE) ..... 199 49 277

(51) Int. Cl.[7] ..... A62C 35/00

(52) U.S. Cl. ..... 169/17; 169/37; 137/68.19; 137/68.23; 137/71

(58) Field of Search ..... 169/17, 37, 16; 137/68.25, 68.23, 68.27, 71, 517, 460, 68.19

(56) References Cited

U.S. PATENT DOCUMENTS

| | | | | | |
|---|---|---|---|---|---|
| 336,442 | A | * | 2/1886 | Schmidt | 220/89.2 |
| 1,311,774 | A | * | 7/1919 | Ritter | 137/71 |
| 1,912,458 | A | * | 6/1933 | Mapes | 169/11 |
| 5,944,113 | A | | 8/1999 | Sundholm | 169/37 |
| 5,967,239 | A | * | 10/1999 | Sprakel et al. | 169/37 |
| 5,979,565 | A | * | 11/1999 | Wicks et al. | 169/17 |
| 6,491,109 | B2 | * | 12/2002 | Christenson et al. | 169/17 |

FOREIGN PATENT DOCUMENTS

| | | | |
|---|---|---|---|
| EP | 0 873 767 | 10/1998 | A62C/35/68 |
| WO | WO 98/58705 | 12/1998 | A62C/31/02 |

* cited by examiner

*Primary Examiner*—Patrick Brinson
(74) *Attorney, Agent, or Firm*—Darby & Darby

(57) ABSTRACT

This invention relates to a fire extinguishing device, with at least one supply line (4) that is dry with the device in an idle state, through which at least one extinguishing nozzle (1) is connected with an extinguishing fluid supply unit, which fills the supply line (4) with an extinguishing fluid if a fire breaks out. The device according to the invention makes it possible to improve a device of the kind mentioned at the outset with simple means in such a way that the air contained in the supply line can rapidly escape while filling with a high operational safety. This is achieved by connecting the supply line (4) with a discharge channel (6), in which a bursting disk (11), which seals the discharge channel (6) in an idle state, and a valve (9), which closes at a pressure higher than the bursting pressure of the bursting disk (9), are situated one after the other in the discharge direction (F).

7 Claims, 2 Drawing Sheets

FIRE-EXTINGUISHING DEVICE

The invention relates to a fire extinguishing device, with at least one supply line that is dry with the device in an idle state, through which at least one extinguishing nozzle closed or open in an idle state is connected with an extinguishing fluid supply unit, which fills the supply line with an extinguishing fluid if a fire breaks out. Devices of this kind are used, for example in frost-endangered and especially sensitive areas, as stationary systems in structures like buildings or ships, so as to be able to effectively fight a blaze if a fire breaks out. The device can be triggered by separate fire alarm boxes, which monitor the respective room or area independent of the extinguishing nozzles. As an alternative or supplement, however, the extinguishing device can be activated by an element located on the extinguishing nozzle itself.

For example, such an element can be a glass vat, which bursts during a rise in temperature caused by a blaze, thereby opening an extinguishing nozzle that had been closed up to that point. The pressure drop that sets in as the extinguishing nozzles open in the supply line held under a specific excess pressure is detected by a pressure monitor, which activates the extinguishing fluid supply unit if the pressure drops below a minimal level in the supply line.

In order to increase the reliability of actuation, a test pressure lying distinctly over the ambient pressure is maintained inside the supply line in the above systems. In this way, the pressure drop is greater when opening the extinguishing nozzle, so that the opening of the respective extinguishing nozzle that accompanies the conflagration is reliably detected.

BACKGROUND OF THE INVENTION

One problem in dry extinguishing systems of the kind described above is that the volume of air present in the supply line must be forced out by the extinguishing fluid introduced into the supply line in the event of a blaze. To this end, the expelled air must escape through the extinguishing nozzles, which may delay the exit of extinguishing fluid. This is particularly problematical in extinguishing devices in which an extinguishing mist is generated by the extinguishing nozzles out of an extinguishing fluid conveyed under an elevated pressure for effective firefighting that causes little water damage. In these devices, the extinguishing nozzles have particularly small hole cross-sections, which act as a kind of restrictor, impeding the outflow of air contained in the supply line.

Other devices also have one or more extinguishing nozzles that are closed in an idle state, and are filled with extinguishing fluid as soon as a fire detector, e.g., a smoke detector, which is used in addition to a tripping element secured to the extinguishing nozzle itself, sends out a signal. Therefore, the system is filled with extinguishing fluid independently of the opening of the extinguishing nozzle. Extinguishing fluid can only exit the extinguishing nozzle after the latter has been opened by a tripping element secured to it. The supply line can only be filled to the extent that the air contained therein can be compressed if the extinguishing nozzles have not yet been opened. If one or more extinguishing nozzles open, the air must first escape before the supply line can be completely filled with water.

The object of the invention is to improve a device of the type mentioned above with simple means in such a way that the air contained in the supply line can rapidly escape while filling with a high operational safety.

SUMMARY OF THE INVENTION

This object is achieved according to the invention by connecting the supply line with a discharge channel, in which a bursting disk, which seals the discharge channel in an idle state, and a valve, which closes at a pressure higher than the bursting pressure of the bursting disk, are situated one after the other in the discharge direction. The valve situated behind the bursting disk in the air discharge direction can here be easily realized by means of a check valve.

According to the invention, a discharge channel sealed in a special way in an idle state is provided, which ensures the rapid outflow of air while filling without any problem. To this end, the discharge channel is sealed by a bursting disk in an idle state. This bursting disk bursts at a specific bursting pressure. The bursting pressure can be selected in such a way as to lie slightly above the resting pressure to give a sufficient level of safety. This ensures that the bursting disk bursts with a rise in pressure, which is caused by the extinguishing fluid being filled into the air contained in the dry supply line. After the bursting disk has burst, the air contained in the supply line can pass through the discharge channel unimpeded via the downstream valve, and escape into the open. The valve situated in back of the bursting disk in the direction of airflow is here designed in such a way as to only close when exposed to the pressure of the extinguishing fluid. In this way, the combined arrangement according to the invention of a bursting disk and a valve that closes at a specific pressure ensures that the extinguishing fluid exits the respective extinguishing nozzle without delay after activation of liquid fluid supply unit.

The unimpeded, complete escape of the air sealed in the supply line can be ensured in a particularly effective manner by situating the discharge channel at the end of an extinguishing section. As an alternative, the discharge channel can be situated in the respective extinguishing nozzle itself. The extinguishing nozzles provided with discharge channels have a compact, functionally reliable design, which is easy to manufacture and assemble.

The invention is particularly well suited in relation to fire extinguishing devices in which the extinguishing fluid supply unit supplies the extinguishing fluid to the supply line under a high pressure. Precisely in these kinds of extinguishing systems, it must be ensured that the extinguishing fluid gets rapidly to the extinguishing nozzles, unimpeded by the air sealed in the supply line. The invention has proven itself as fit for use in practice precisely in those extinguishing devices that are especially problematical in conjunction with the conventional mode of venting, in which the extinguishing nozzle generates an extinguishing mist. Since the air sealed in the supply line does not have to escape through the extinguishing nozzle, the rapid discharge of extinguishing mist in the event of a blaze is ensured by this invention precisely in such systems, despite the small cross section of the nozzle holes.

The invention will be described in greater detail below based on a drawing that shows an embodiment.

THE DRAWINGS

DETAILED DESCRIPTION

Figure 1:
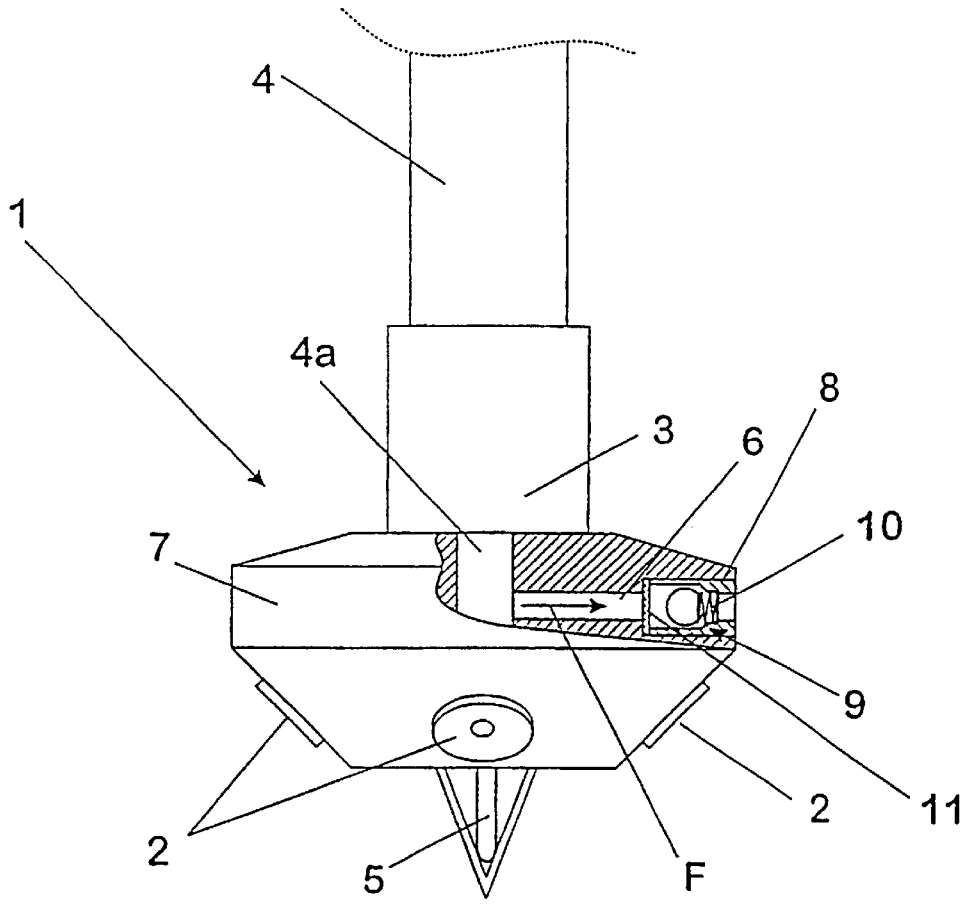
FIG. 1 is an extinguishing nozzle in a partially cut side view.

The extinguishing nozzle 1 is equipped with several open nozzle inserts 2, which respectively generate an extinguishing mist when exposed to extinguishing fluid under a high pressure. The extinguishing nozzle 1 is connected to the terminal 3 of a supply line 4, which links the extinguishing nozzle 1 with an extinguishing fluid supply unit (not shown).

In addition, the extinguishing nozzle 1 is equipped with a glass vat 5, against which a spring-loaded piston (not shown) is supported in an idle state. In an idle state, the piston seals the junction channel 4*a* formed in the extinguishing nozzle 1 between the holes in the nozzle inserts 2 and the supply line 4.

A discharge channel 6 is molded into the upper end of the extinguishing nozzle 1 extending from the junction channel 4*a* directed radially outward, and ends on a radial peripheral surface 7 of the extinguishing nozzle 1. Inserted in a receiver 8 formed in the outlet area of the discharge channel 6 is a check valve 9 pre-stressed against the discharge direction F by means of a spring 10, which is held in its open position by the spring in an idle state. At the same time, the discharge channel 6 is sealed by a bursting disk 11 in front of the check valve 9 in an idle state in the discharge direction F.

If a fire breaks out, the glass vat 5 melts or bursts due to the evolution of heat, so that the spring-loaded piston of the extinguishing nozzle 1 is moved into a position that releases an inflow from the supply line 4 to the nozzle inserts 2. The pressure drop that accompanies the opening of the extinguishing nozzles 1 in the air sealed in the supply line 4 and held under a test pressure in an idle state is detected by a pressure monitor (not shown) of the extinguishing fluid supply unit, which then activates the extinguishing fluid supply unit.

The extinguishing fluid penetrating into the supply line 4 causes a pressure rise in the air sealed in the supply line 4, because the air cannot escape fast enough via the nozzle inserts 2. As soon as the pressure of the air in the supply line 4 has exceeded the bursting pressure of the bursting disk 11, the bursting disk 11 bursts, and the air can escape into the environment via the discharge channel 6. The force of the spring 10 exceeds the force corresponding to the bursting pressure of the bursting disk 11 by an amount that keeps the check valve 9 open as the air escapes. However, as soon as the extinguishing fluid has also reached the discharge channel 6, the check valve 9 is closed, since the selected force of the spring 10 is in turn smaller than the force corresponding to the pressure of the extinguishing fluid.

Figure 2:
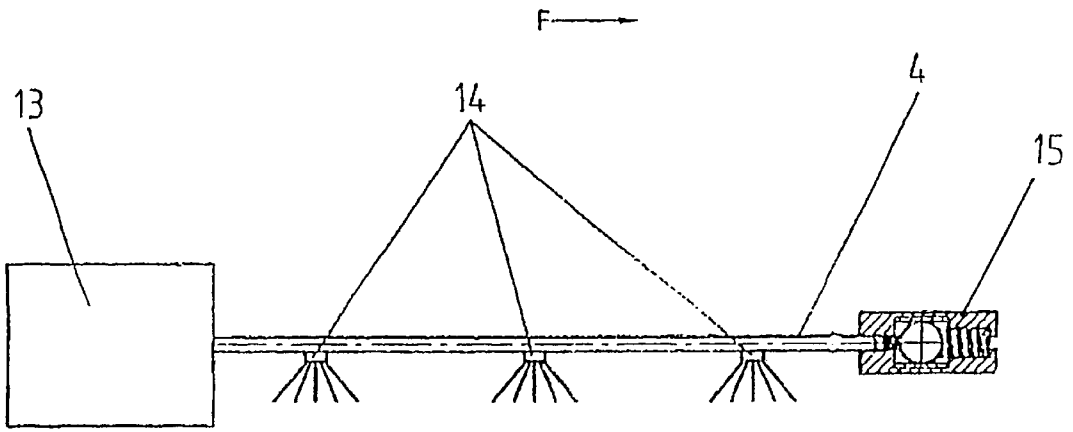
FIG. 2 is an alternative configuration of the device.
Figure 3:
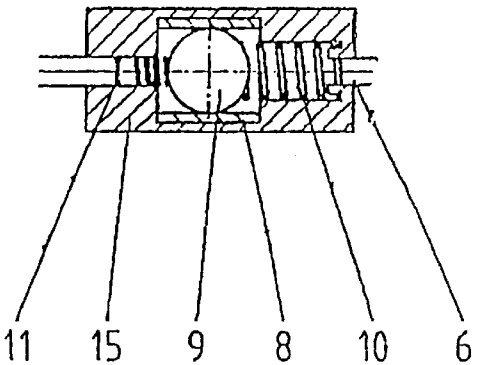
FIG. 3 is the venting arrangement of the device according to FIG. 3, in detail.

FIG. 2. shows another embodiment of the invention. Several extinguishing nozzles 14 closed in an idle state are connected by a supply line 4 with an extinguishing fluid supply unit 13 not described in greater detail. Located at the end of the pipe network is a venting device 15, which has a discharge channel 6. Inserted in a receiver 8 formed in the outlet area of the discharge channel 6 is a check valve 9 pre-stressed against the discharge direction F by means of a spring 10, which is held in its open position by the spring in an idle state. At the same time, the discharge channel 6 is sealed by a bursting disk 11 in front of the check valve 9 in an idle state in the discharge direction F. If a fire breaks out, at least one of the extinguishing nozzles opens. The pressure drop that accompanies the opening of the extinguishing nozzles 14 in the air sealed in the supply line 4 and held under a test pressure in an idle state is acquired by a pressure monitor (not shown) of the extinguishing fluid supply unit 13, which then activates the extinguishing fluid supply unit 13.

The extinguishing fluid penetrating into the supply line 4 causes a pressure rise in the air sealed in the supply line 4, because the air cannot escape fast enough via the extinguishing nozzles 14. As soon as the pressure of the air in the supply line 4 has exceeded the bursting pressure of the bursting disk 11, the bursting disk 11 bursts, and the air can escape into the environment via the discharge channel 6. The force of the spring 10 exceeds the force corresponding to the bursting pressure of the bursting disk 11 by an amount that keeps the check valve 9 open as the air escapes. However, as soon as the extinguishing fluid has also reached the discharge channel 6, the check valve 9 is closed, since the selected force of the spring 10 is in turn smaller than the force corresponding to the pressure of the extinguishing fluid.

| KEY | |
|---|---|
| 1 | Extinguishing nozzle |
| 2 | Nozzle insert |
| 3 | Terminal of supply line 4 |
| 4 | Supply line |
| 4a | Connecting channel |
| 5 | Glass vat |
| 6 | Discharge channel |
| 7 | Peripheral surface |
| 8 | Receiver |
| 9 | Check valve |
| 10 | Spring |
| 11 | Bursting disk |
| 12 | Pipe network |
| 13 | Extinguishing fluid supply unit |
| 14 | Extinguishing nozzle |
| 15 | Venting device |
| F | Discharge direction |

What is claimed is:

1. A fire extinguishing device, with at least one supply line (4) that is dry when the device is in an idle state, and at least one extinguishing nozzle (1; 14) connected to an extinguishing fluid supply unit (13) by said supply line, wherein the supply line (4) is filled with an extinguishing fluid if a fire breaks out, comprising a discharge channel (6) having a bursting disk (11) connected to said supply line, said bursting disk sealing the discharge channel (6) in an idle state, and a valve, which closes at a pressure higher than the bursting pressure of the bursting disk (11), positioned after the bursting disk in the discharge direction (F).

2. A device according to claim 1, wherein the valve is a check valve (9).

3. The device according to claim 1, wherein the discharge channel (6) is formed in close proximity to the extinguishing nozzle (1).

4. The device according to claim 1, wherein the discharge channel (6) is situated in an extinguishing nozzle (1; 14).

5. The device according to claim 1, wherein an excess pressure prevails in the supply line (4) in an idle state.

6. The device according to claim 1, wherein the extinguishing fluid supply unit (13) introduces the extinguishing fluid into the supply line (4) under a high pressure.

7. The device according to claim 1, wherein the extinguishing nozzle (1; 14) has a nozzle insert (2) that generates an extinguishing mist.

* * * * *